United States Patent [19]

Geist

[11] 4,316,297

[45] Feb. 23, 1982

[54] TUMBLING FLOOR

[75] Inventor: John K. Geist, Cedar Rapids, Iowa

[73] Assignee: Nissen Corporation, Cedar Rapids, Iowa

[21] Appl. No.: 140,211

[22] Filed: Apr. 14, 1980

[51] Int. Cl.[3] ..... A47G 9/00; A63B 5/18

[52] U.S. Cl. ..... 5/420; 52/309.8

[58] Field of Search ..... 5/417, 418, 419, 420; 52/309.8, 309.4, 273, 402; 272/101, 109

[56] References Cited

U.S. PATENT DOCUMENTS

D. 174,812 5/1955 Haller ..... 5/420
2,961,029 11/1960 Rainar ..... 428/310
3,684,630 8/1972 Sensenig et al. ..... 52/309.8
3,720,027 3/1973 Christensen ..... 52/309.8

FOREIGN PATENT DOCUMENTS 2419084 5/1979 France ..... 5/420

*Primary Examiner*—Alexander Grosz
*Attorney, Agent, or Firm*—Haven E. Simmons; James C. Nemmers

[57] ABSTRACT

A tumbling floor features an assembly of rigid panels beneath each of which is an array of soft foamed blocks of cushioning material which rest upon the gymnasium floor. The panels are covered by foamed panels of soft springing material and the latter in turn covered by a thin carpet providing a non-slip surface.

4 Claims, 4 Drawing Figures

TUMBLING FLOOR

The primary object of the present invention, therefore, is a tumbling floor which provides adequate cushioning and springing characteristics for tumbling but which is relatively inexpensive, durable, quiet in operation and non-injurious to the gymnasium floor upon which it is laid.

SUMMARY OF THE INVENTION

The invention essentially reverses the approaches of the prior art. Instead of placing the springing below and the cushioning above, it does the opposite, with significantly improved results in terms of performance and cost and noise reduction. Floor panels similar to that extent to those of the prior art are used, but rather than mounting springs beneath them, a large array of blocks of foamed cushioning material are adhered to the panel underfaces and directly engage the gymnasium floor. The number and thickness of the blocks beneath each panel is so arranged that in conjunction with the panel the combination provides measurably more cushioning than springing. The separate panels are simply butted against one another, supported at their inner corners, and circumscribed by cables and turn-buckles attached to exterior corner brackets to keep the panels so assembled. Then the top of the assembled panels is covered with sections of foamed soft springing material simply taped together. The latter material provides some cushioning but chiefly springing. The foamed springing material in turn is covered with several pieces of relatively thin, ordinary carpet material, also taped together, to provide a non-slip surface.

All the components are relatively inexpensive and together uniquely cooperate to provide a well cushioned and sprung tumbling floor which is also durable, quiet in operation and non-injurious to the gymnasium floor. Other features and advantages of the invention will appear from the following detailed description and the drawings.

DETAILED DESCRIPTION OF THE PREFERRED EMBODIMENT

Figure 1:
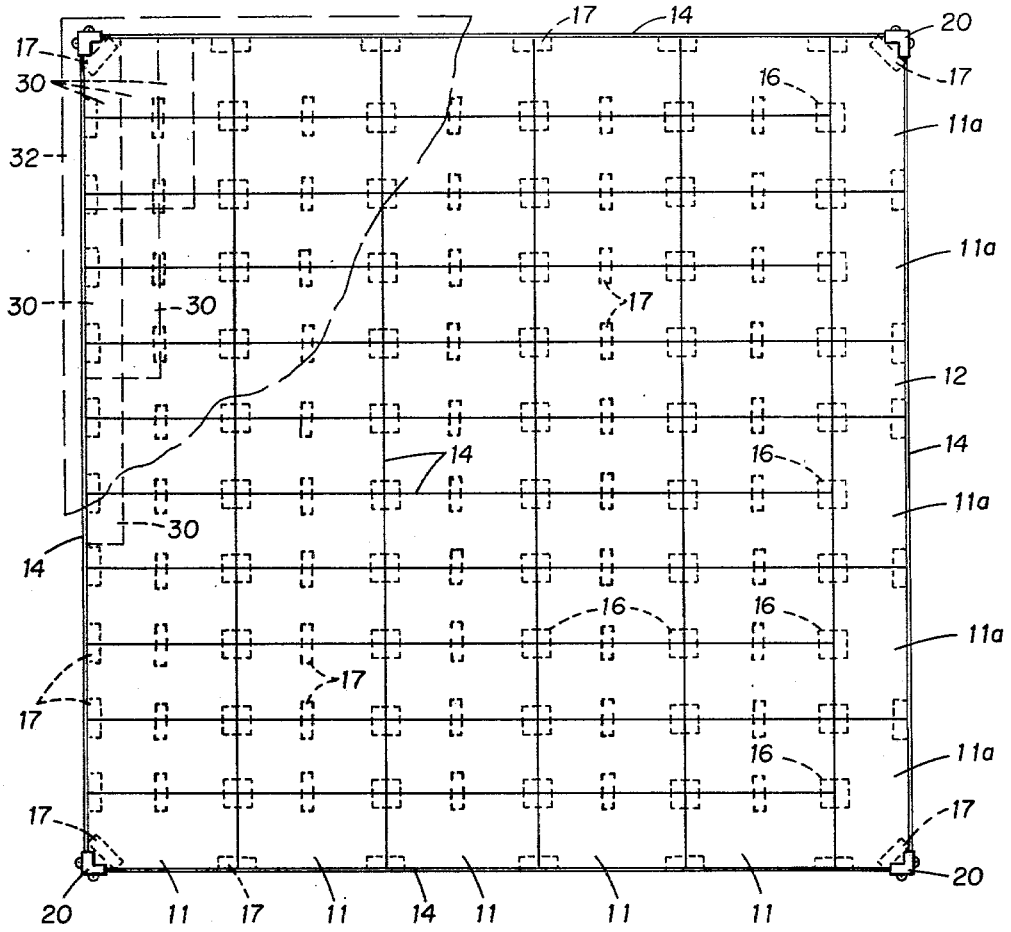
FIG. 1 is a top plan view of the tumbling floor of the present invention with portions of the foamed springing material and carpet cover shown in broken lines in order to illustrate the arrangement of the underlying floor panels.
Figure 2:
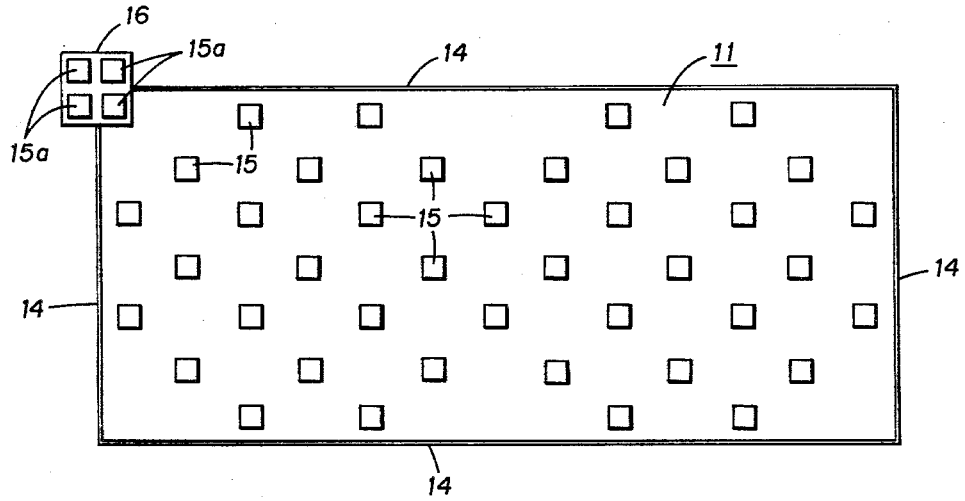
FIG. 2 is a bottom plan view of one of the floor panels of FIG. 1.
Figure 4:
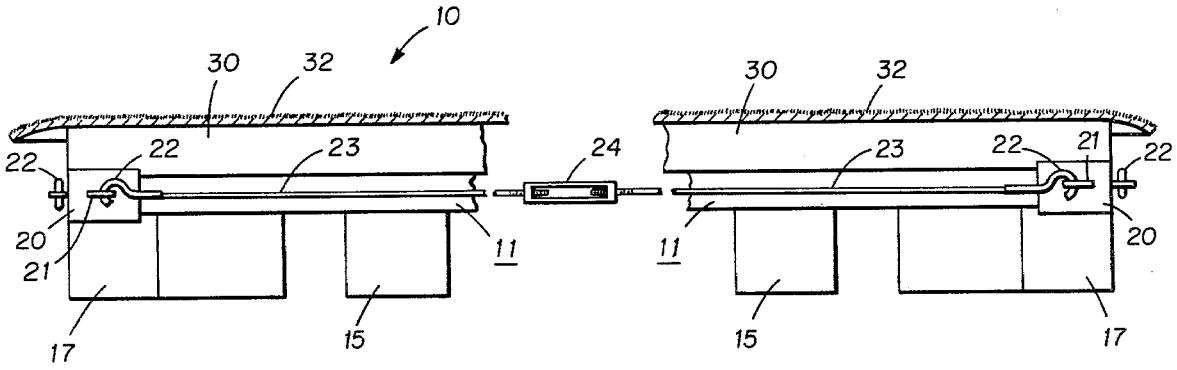
FIG. 4 is a side elevation of the floor of FIG. 1 but showing the springing material and carpet cover in place and the manner in which the floor panels are held assembled.
Figure 3:
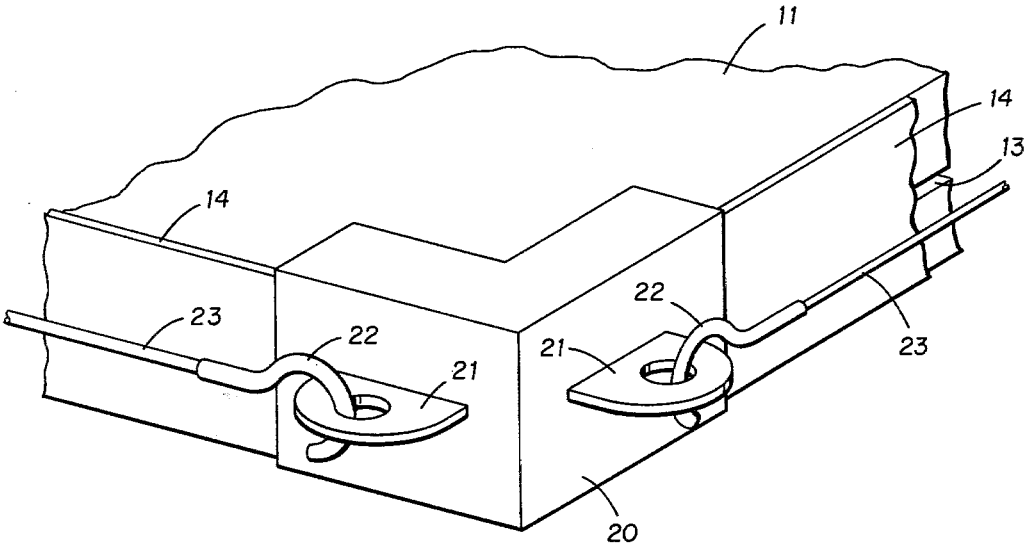
FIG. 3 is a detailed view of one of the four exterior corners of the floor shown in FIG. 1.

Underlying the tumbling floor 10 and as shown in FIGS. 1 and 4, is an array of 60 essentially identical floor panels 11 each four feet by eight feet, and one half-panel 12, four feet by four feet, assembled as shown to provide a floor area forty-four feet square. Other panel dimensions and other arrangements of course could be used to give different sizes and configurations to the floor 10. Each panel 11 and the panel 12 employs a fine face particle board, ¾ inches thick, sold under the trademark NOVAPLY by Champion Building Products Division of Champion International Corporation of Stamford, Conn., and are characterized by their rigidity and hard exterior surfaces. Ordinary plywood, for instance, could be used, but the foregoing particle board is preferred because it is more rigid and not susceptible to warping. For finishing purposes the edges of each panel 11 and the panel 12 are grooved at 13, as shown in FIG. 3, to receive the tongues of strips of T-shaped plastic edging 14. To the under face of each panel 11 are cemented a large number of blocks 15 of foamed plastic cushioning material, 38 being shown, arranged in the pattern shown in FIG. 2. The half panel 12 is similarly provided with identical blocks 15. The blocks 15 are each three inches square and two inches high and are cut from planks of a lightweight, closed cell, expanded polyvinylchloride sold under the trademark SPONGEX by Housatonic Ever-Float, Inc. of Shelton, Conn. That material is available in "very soft" to "hard" grades, and that used for the blocks 15 is designed by its manufacturer as "VS-300".

The floor panels 11 and 12 are simply butted against each other edgewise in the assembled order shown in FIG. 1. In the cases where there are four abutting interior corners of the panels 11, four additional blocks 15, designated 15*a*, are cemented instead to nine inch square metal plates 16, one being shown in FIG. 2, and arranged as indicated in FIG. 1 to prevent misalignment of the panels 11 when struck by a performer. A similar arrangement for the same purpose is made with respect to the inner long sides of the five panels 11, designated 11*a*, along the righthand end of the floor 10, also as indicated in FIG. 1. Then beneath the abutting corners of the panels 11 about the perimeter of the floor 10, as well as under the four exterior corners of the latter, are laid rectangular blocks 17 of the same material and height as the blocks 15 (see FIG. 1). Channeled corner brackets 20 embrace each of the four exterior corners of the assembled panels 11, 11*a* and 12, each bracket 20 having a pair of horizontally extending ears 21 drilled through to receive hooks 22 (see FIG. 3). The latter hooks along each side of the assembled panels 11, 11*a* and 12 are connected by cables 23 and a turn-buckle 24 which when tightened pulls all the panels 11, 11*a* and 12 into tight edge-to-edge engagement.

By selecting appropriate thickness, surface area, and number of the blocks 15, 15*a* and 17 beneath the panels 11, 11*a* and 12, each of the latter can be given a "co-efficient of restitution" low enough so as to provide much more cushioning than springing. Here and in the appended claims, the "co-efficient of restitution" means the quotient of the "rebound velocity" and the "impact velocity" of a hard object of given shape and weight striking a given sample of same from a given elevation. In the case of the construction given for panels 11, 11*a* and 12 such co-efficient of restitution of each is in the 40 to 50 percent range. Fewer and/or smaller blocks 15 would give a still lower co-efficient while more and/or larger blocks would give a higher one.

The assembled floor panels 11, 11*a* and 12 shown in FIG. 1 are then covered by two foot by nine foot spring panels 30 (see FIGS. 1 and 4) of springing material taped together along their top edges in conventional manner. The spring panels 30 average approximately one and three-eighths inches thick and are one of the closed cell polyethylene foams manufactured by Dow Chemical Company at Hanging Rock, Ohio under the trademark ETHAFOAM. That used is a particularly "soft" grade, designated by its manufacturer as "XFS-4292.01", which is distinguished by its high rebound characteristics, its "co-efficient of restitution", as determined by the "ASTM #355 Drop Test," being in the 90–98% range. So far as is known that particular grade of ETHAFOAM or similar material has never been used for gymnastic purposes such as tumbling because it is so "soft" it would bottom-out if used alone in a gymnastic mat of typical thickness. The spring panels 30 are covered, in turn, by several pieces of relatively thin carpet 32 of any suitable nature which protects the panels 30 and also provides a non-slip top surface. The strips of carpet 32 are likewise taped together along their adjoining edges in a conventional manner. It is unnecessary to secure the carpet 32 to the panels 30 or the latter to the panels 11 and 12 owing to the relatively great surface area contact between the same.

Accordingly, when a performer strikes the floor 10 the panels 11, 11*a* and 12, owing to the blocks 15, 15*a* and 17, provide the desirable cushioning while the panels 30 provide the necessary springing, all efficiently and quietly and all relatively inexpensively and durably. Though the present invention has been described in terms of a particular embodiment, being the best mode so far known of carrying out the invention, it is not limited to that embodiment alone. Instead, the following claims are to be read as encompassing all adaptations and modifications of the invention falling within its spirit and scope.

I claim:

1. A floor for tumbling and the like comprising: a plurality of rigid cushioning panels having opposite bottom and top faces, each of the cushioning panels having a plurality of discrete pieces of cushioning material spaced over its bottom face in order to support the panel in parallel spaced position above a hard underlying surface, the dimensions and distribution of said pieces over said panel face providing a co-efficient of restoration for the panel in the range of about 40 to 50 percent in order to primarily cushion rather than rebound a performer landing upon the panel top face, the cushioning panels being assembled in abutting relation on said underlying surface to provide a large uniform surface formed by the panel top faces; means to maintain the cushioning panels in said abutting relation; and a plurality of abutting springing panels of springing material disposed upon and covering the panel top faces, said springing material having a co-efficient of restoration in the range of about 90 to 98 percent in order to primarily rebound rather than cushion a performer landing upon the springing panels.

2. The floor of claim 1 in which the cushioning material comprises a closed cell expanded polyvinylchloride foam.

3. The floor of claim 2 in which the springing material comprises a closed cell polyethylene foam.

4. The floor of claim 1, 2, or 3 including a cover of relatively thin non-slip material disposed over the panels of springing material.

* * * * *